United States Patent [19]

Verity

[11] 4,376,642

[45] Mar. 15, 1983

[54] PORTABLE AIR CLEANER UNIT

[75] Inventor: Nigel C. Verity, Dorval, Canada

[73] Assignee: Biotech Electronics Ltd., Dorval, Canada

[21] Appl. No.: 241,517

[22] Filed: Mar. 9, 1981

Related U.S. Application Data

[63] Continuation-in-part of Ser. No. 159,841, Jun. 16, 1980, abandoned.

[30] Foreign Application Priority Data

Aug. 18, 1980 [CA] Canada ..... 358492

[51] Int. Cl.[3] ..... B03C 3/01; B03C 3/12; B03C 3/32

[52] U.S. Cl. ..... 55/105; 55/126; 55/132; 55/155; 55/279; 55/467; 55/499; 55/139; 422/121

[58] Field of Search ..... 55/103, 126, 131, 132, 55/155, 279, 467, 482, 499, DIG. 13, DIG. 39, 105, 139, 512, 516, 517; 422/121

[56] References Cited

U.S. PATENT DOCUMENTS

| | | | |
|---|---|---|---|
| 1,843,446 | 2/1932 | Dräger | 55/517 |
| 3,191,362 | 6/1965 | Bourgeois | 55/126 |
| 3,587,210 | 6/1971 | Shriner | 55/131 |
| 3,744,216 | 7/1973 | Halloran | 55/279 |
| 3,828,530 | 8/1974 | Peters | 55/482 |
| 3,841,840 | 10/1974 | Hundausen et al. | 55/132 |
| 3,853,529 | 12/1974 | Boothe et al. | 55/499 |
| 3,861,894 | 1/1975 | Marsh | 55/316 |
| 3,973,927 | 8/1976 | Furchner et al. | 55/139 |
| 4,099,943 | 7/1978 | Fischmane et al. | 55/DIG. 13 |
| 4,133,652 | 1/1979 | Ishikawa et al. | 55/126 |
| 4,133,653 | 1/1979 | Soltis | 55/126 |
| 4,178,157 | 12/1979 | Turnhout et al. | 55/155 |
| 4,215,682 | 8/1980 | Kubik et al. | 55/103 |
| 4,229,187 | 10/1980 | Stockford et al. | 55/103 |
| 4,232,355 | 11/1980 | Finger et al. | 55/139 |
| 4,245,550 | 1/1981 | Suzuki et al. | 55/126 |

FOREIGN PATENT DOCUMENTS

| | | | |
|---|---|---|---|
| 1193100 | 10/1959 | France | 55/103 |
| 606602 | 5/1978 | U.S.S.R. | 55/103 |

*Primary Examiner*—David L. Lacey
*Attorney, Agent, or Firm*—Shapiro and Shapiro

[57] ABSTRACT

The invention relates to a portable air cleaner unit which includes a casing having an air inlet and an outlet and defining an air cleaning path between the inlet and outlet. A prefilter is disposed downstream of the air inlet and a main filter is disposed downstream of the prefilter. An air mover such as a fan is disposed downstream of the main filter, and an exposed negative ion source is disposed downstream of the fan on the external surface of the air outlet. In accordance with the invention, the main filter consists of fibers shredded from a non-carcinogenic plastic membrane which has been permanently electrostatically charged. The negative ion source ionizes the cleaned air as it leaves the cabinet.

14 Claims, 3 Drawing Figures

PORTABLE AIR CLEANER UNIT

CROSS-REFERENCE TO RELATED APPLICATION

This is a continuation-in-part application of parent application Ser. No. 159,841, filed June 16, 1980, now abandoned.

BACKGROUND OF INVENTION (a) Field of the Invention

The invention relates to an air cleaner unit which uniquely combines the benefits of environmental ionization with the advantages of using a permanently charged shredded electret type air filter.

(b) Description of Prior Art

Known in the art are teachings relating to air cleaning units, air pollution reduction units, and filters for use in these units. These teachings are documented in, for example, U.S. Pat. Nos. 3,735,560 to D. C. Wellman, issued May 29, 1973; 3,783,588 to M. Hudis, issued Jan. 8, 1974; 3,861,894 to R. C. Marsh, issued Jan. 21, 1975; 4,115,082 to J. H. Newell, issued Sept. 19, 1978; and 4,133,653 to C. W. Soltis, issued Jan. 9, 1979; 4,215,682 to Kubik et al, August 1980; 3,744,216 to Halloran, July 10, 1973; 3,841,840 to Hundhausen et al, Oct. 15, 1974; 3,587,210 to Shriner, June 28, 1971; 4,133,652 to Ishikawa et al, Jan. 9, 1979; 3,191,362 to Bourgeois, June 29, 1965; 3,853,529 to Boothe et al, Dec. 10, 1974; 3,828,530 to Peters, Aug. 13, 1974; French Patent No. 1,193,100, Oct. 30, 1959, and U.S.S.R. Patent No. 606,602, May 25, 1978. U.S. Pat. No. 4,069,026, issued Jan. 17, 1978, to Sim et al, teaches a method for producing electrostatically spun fibers.

None of the prior art references teach an air cleaner unit wherein the main filter comprises fiber which have been shredded or fibrillated from a permanently charged foil which is used in combination with a negative ion source placed on the external surface of the unit for the purpose of negatively ionizing the external air to a very high level, high enough to be bacteriocidal. Only if the ion source is placed is an exposed position on the external surface of the unit can adequate external ionization be achieved and this is innovatively done without posing an electrical shock hazard to the user by using special internal circuitry.

Prior art U.S. Pat. No. 4,133,652 teaches the use of an internal negative ionizer generally for the purpose of neutralizing the positive ions generated in the upstream charging section of the electronic precipitator and for adding a comparatively low level of negative ions to the discharged air. The ion source being internal to the unit, i.e., placed behind either a non-conductive plastic diffuser (FIG. 1), or behind a non-conductive plastic protection grid (FIG. 3), for the purpose of protecting the user from electrical shock hazard, results in a build up of a negative charge on the plastic material downstream of the emitter source. This charge build up repells the oncoming negative ions and results in a comparatively very low level of negative ionization external to the unit. In contrast, as will be described hereinafter, the invention provides an air cleaner unit having a negative ion source located at a grill covering the air outlet of the unit and exposed so as to afford substantially unimpeded emission of ions into the air external to the grill, thereby resulting in more efficient ionization of the external air.

In order to achieve significantly effective air cleaning of submicron particles such as disclosed in either (A) Electrostatic precipitation U.S. Pat. Nos. 3,841,840; 4,133,652; 3,191,362, or (B), HEPA filters such as disclosed in U.S. Pat. Nos. 3,828,530 and 3,861,894 have been employed.

A. Electrostatic Precipitators

Electrostatic precipitators consist of a charging section which usually charges the particulate contaminants positively by using very high voltages typically 6,000 V applied to an ionization wire placed fairly close to a grounded or much lower potential plate. The particles, once having been charged, then pass between a multiplicity of alternatively charged plates which attract them to their surface thus cleaning the air stream. These precipitators present a low resistance to air flow but suffer from the following disadvantages:

i. Poor efficiency which generally deteriorates quickly after they have been cleaned as the level of contamination builds up on the internal parts.

ii. They tend to generate large amounts of ozone which can be potentially hazardous if they are used in small enclosed spaces.

iii. They require frequent cleaning and maintenance.

iv. They arc over when contamination builds up which causes load noises and radio and television interference.

B. HEPA (High Efficiency Particulate Arrester) Filters.

HEPA filters clean the air stream passing through them by mechanically trapping the particles that are either too big to pass through the fine mesh of the filter, or because the long and tortuous route the air takes on its way through the filter significantly improves the chances of the particles being caught.

For this reason the filter media have had to consist of a multiplicity of very small fibers whose cross-sectional diameters were of the same order of magnitude as the smallest particles to be captured. As a result of their extremely dense nature HEPA filters are generally expensive and offer considerable resistance to air flow which results in the need for large, usually noisy and energy consuming air movers in air cleaners which use them.

In the past air cleaner designed to provide a sterile environment were bulky, noisy, complicated and very expensive. They also required a great deal of maintenance and cleaning (see, for example, U.S. Pat. No. 3,744,216 which employs fluidic oxidizers, UV lamps, powered electrostatic path lengthening to enhance the efficiency of a paper filter and two blowers in order to overcome the relatively high airflow resistance of the setup).

SUMMARY OF THE INVENTION

It is an object of the invention to provide a simpler, less expensive, quieter, more efficient air cleaner unit which will be effective on submicron particulate contaminations and at the same time provide a high level of negative ionization in the room or space in which it is placed.

It is a more specific object of the invention to provide such a simpler, less expensive, quieter, more efficient air cleaner unit by using therein a main filter means which comprises fibers shredded or fibrillated from a non-carcinogenic plastic membrane which has been permanently electrostatically charged; and it is a further specific object of the invention to provide such an air cleaner unit which will provide a high level of negative ionization in the room or space in which it is placed by utilizing therein an exposed negative ion source on the external surface of the air outlet of the air cleaner unit. The thus exposed negative ion source serves to ionize the air external to the unit so that currents of discharged air from the unit will carry negative ions far into the surrounding air space.

In a preferred embodiment, the exposed negative ion source is of the cold corona point source type. A special current limiting circuit is provided to protect users from shock hazard from the high voltage source which drives the negative ion source.

In accordance with a particular embodiment of the invention, an air cleaner unit comprises:

a casing having an air inlet and an air outlet and defining an air cleaning path between said air inlet and said air outlet;

prefilter means disposed across said path comprising a material suitable for removing particles or fibers in excess of 10 microns in diameter;

main filter means disposed across said path between said prefilter means and said air outlet and comprising fibers shredded or fibrillated from a non-carcinogenic plastic membrane which has been permanently electrostatically charged;

air moving means disposed along said path for moving the air from said inlet to said outlet;

an exposed negative ion source disposed on the external surface of said air outlet and driven by an internal power supply; and means for limiting the current of said power supply to protect users from receiving hazardous electrical shocks from said exposed negative ion source.

Because said main filter means presents relatively little resistance to the flow of air therethrough, said unit can conveniently produce a through-put of any value, whether fixed or variable, in the range of 0 to 900 cubic feet per minute of air, for example.

BRIEF DESCRIPTION OF THE DRAWINGS

The invention will be better understood by an examination of the following description together with the accompanying drawings in which.

DESCRIPTION OF PREFERRED EMBODIMENTS

Figure 1:
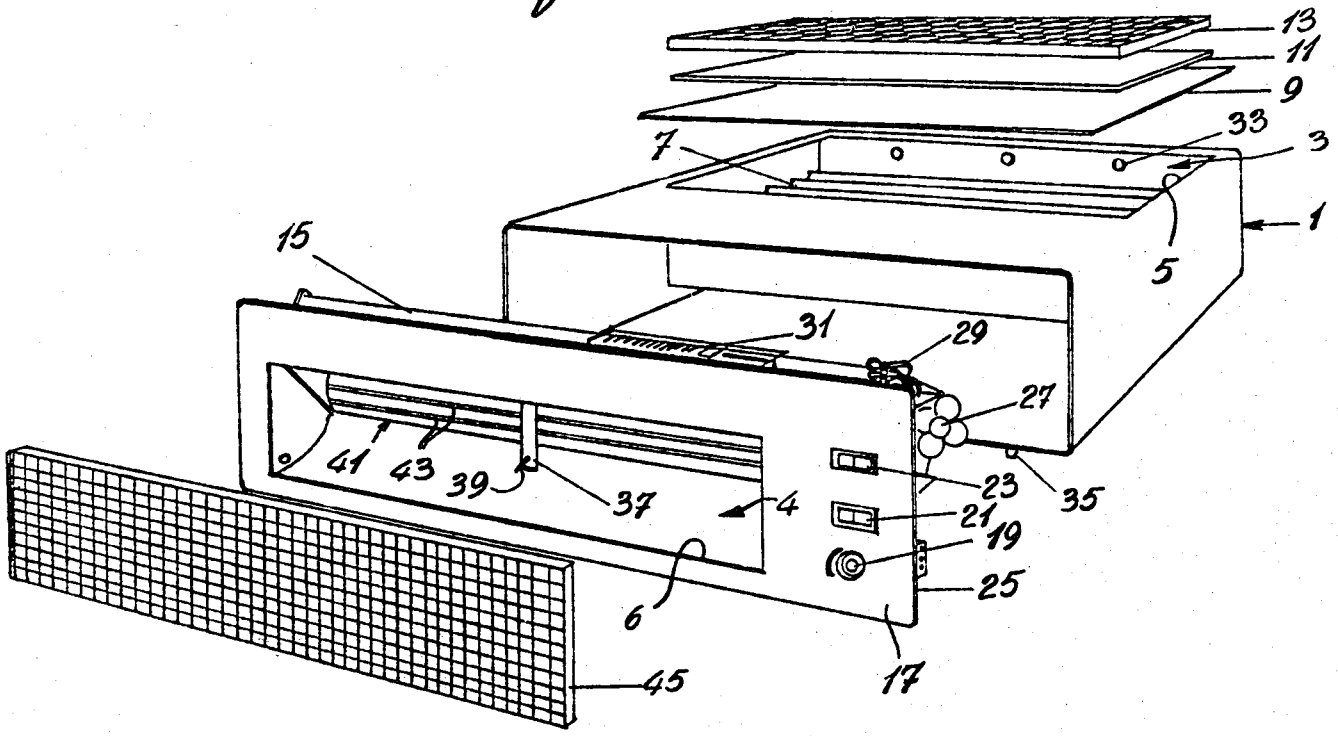
FIG. 1 is an exploded view of one embodiment of the air cleaner unit in accordance with the invention.
Figure 2:
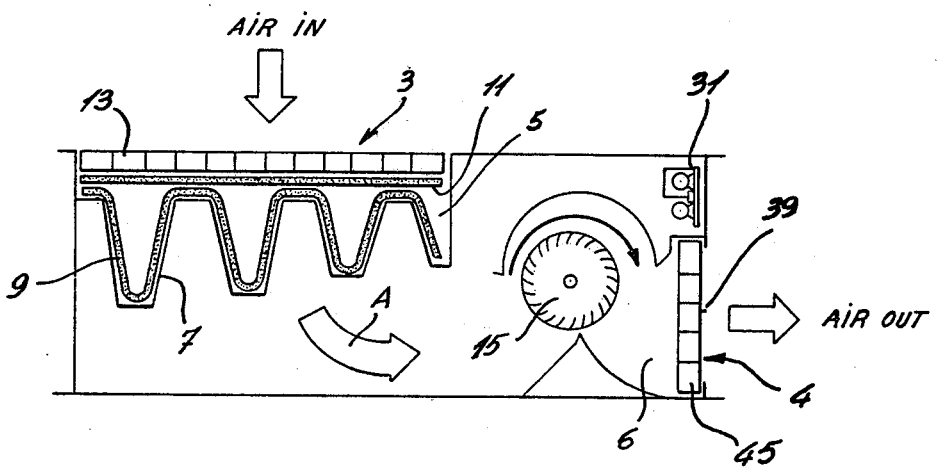
FIG. 2 is a conceptual block diagram of an air cleaner unit in accordance with the invention.

Referring now to FIGS. 1 and 2, the air cleaner unit comprises a casing 1 illustrated as a six walled cabinet, each of the six walls of the cabinet being somewhat rectangular in shape. An air inlet 3 is located in the top wall, and an air outlet 4 is located in the front wall thereof. An air cleaning path, illustrated by arrow A in FIG. 2, is defined between the inlet and outlet. Ducts 5 and 6 face inlet 3 and outlet 4, respectively, and constitute inlet and outlet ducts, respectively. It will of course be appreciated that the inlet and outlet openings could be disposed, respectively, in different walls of the cabinet, and a different shaped cabinet could be used, without departing from the spirit of the present invention.

Disposed in inlet duct 5 is a folded main filter carrier 7 which is somewhat corrugated in shape, as best illustrated in FIG. 2, and which may be of slotted sheet steel. A main filter 9 is mounted on the carrier 7 as will be described below, the carrier and the main filter constituting main filter means. Prefilter means 11 rests on the formed main filter means between the main filter means and the inlet 3. A grill 13 then covers the inlet opening. The grill may be supported on rubber bumpers 33 (FIG. 1) within the inlet duct.

The prefilter means is made of a material suitable for removing large particles or fibers (in excess of 10 microns in diameter), such as cat hair, dog hair, or carpet fluff. In a preferred embodiment, the prefilter means comprises a porous polyurethane material.

The main filter 9, as will be described more fully hereinafter, preferably is composed of millions of fibers shredded from a non-carcinogenic plastic membrane which has been permanently electrostatically charged (commonly referred to as a shredded electret). One process for producing the material of the main filter is described in U.S. Pat. Nos. 3,998,816 to S. Seki et al, issued Dec. 21, 1976; 4,178,157 to J. van Turnhout et al, issued Dec. 11, 1979; and Canadian Patent No. 1,050,481 to J. van Turnhout, issued Mar. 13, 1979. Disposed in outlet duct 6 is a means for moving air which, in the illustrated embodiment, comprises a fan or blower 15 located downstream of the main filter means. The means for moving air may also be located upstream of the main filter means (between the prefilter means and the main filter means).

The fan is designed to draw in air evenly across the inlet and to distribute it outwardly evenly across the outlet. In a preferred embodiment, the fan comprises a tangential fan air mover which will be more specifically described below.

Also disposed on the front wall are control switches 19, 21 and 23. Switch 19 controls the speed of the motor (not shown) for driving the fan which controls the air flow, while switch 21 is a fan motor ON/OFF switch. Switch 23 is the ionization ON/OFF control switch, the function of which will be discussed below.

As shown in FIG. 1, disposed behind the front wall 17 is a main chassis 25 on which is mounted the motor for driving the fan. The chassis also includes a fan 27 for cooling the motor, wiring 29, and a printed circuit board 31, which will be further described below.

Extending downwardly across the outlet 4 is a finger 37 which supports the negative ion source 39. The negative ion source, which may be a cold corona point source as previously mentioned, comprises an ionizer needle which is connected to the current limiting power supply circuitry, illustrated in FIG. 3, on printed circuit board 31. The ionization ON/OFF control switch 23 may control the power to the negative ion source. As can be seen best in FIG. 2, the negative ion source is exposed on the external surface of the outlet 4. As such ionizer needles are well known in the art, they require no further description at this time.

As shown in FIG. 1, the fan 15 comprises a cylindrical member 41 having a plurality of paddles 43 extending outwardly from the top surface thereof. The axis of the cylinder is parallel with the plane of the outlet, and the paddles run along the length of the cylinder and are parallel to the axis of the cylinder. Grill 45 covers the outlet.

The main filter 9 is mounted on the carrier 7. For this purpose, a wire hanger can be used to stuff the main filter material into the crevices or the corrugations of carrier 7. The prefilter means 11 then rests on the formed main filter means and is held there by gravity alone, and the grill 13 rests on the rubber bumpers 33.

With the fan operating, air is drawn in through the grill 13, through the prefilter means 11 and through the main filter means. It is then forced out through the grill 45 in the outlet 4. As the air passes through the outlet, it is ionized by the negative ion source.

The prefilter means is disposed closest to or at the inlet, and the main filter means is disposed downstream of the prefilter means along the air-cleaning path. The fan is disposed downstream of the main filter means and the negative ion source is disposed downstream of the fan and is exposed on the external surface of the outlet, as previously described.

The use of a main filter made of fibers with a permanent electrostatic charge helps to attract and trap pollutants. The material of the main filter approaches a 99.9% efficiency, and the main filter actually becomes more effective with time, i.e., the particles stopped by the charged fibers become part of the main filter as well. As the filter material is non-carcinogenic, it is completely safe. The filter also avoids the problems of "clicking" and popping found with conventional electrostatic cleaners. Unlike electrostatic cleaners, the invention produces no ozone and no radio or television interference.

The use of a shredded or fibrillated electret filter in the invention is unique and highly innovative. It consists of a multiplicity of electret fibers which have been fibrillated from a permanently charged foil. The fibers thus have a rectangular cross section which results in very high voltage gradients being present at their corners. These voltage gradients charge the incoming particulate contaminants in such a way that they are strongly attracted to the next fibers as a result of the interactive electrical forces. In this way the fibrillated electret filters are more effective than the "melt blown fiber" filters of U.S. Pat. No. 4,215,682, Kubic et al, which consist of fibers with a rounded cross section. These "melt blown" fibers do not exhibit the same high voltage gradients concentrated at the corners of their cross section since they have no corners. The reason for this is that they have been created ready made by a "melt blown" process as defined in Kubic et al and are not shredded or fibrillated from a precharged foil as described in Turnhout et al.

The shredded or fibrillated main filter used in the invention presents little resistance to air flow. This is because the fibers can be much larger than the smallest particles to be trapped since they trap the particles by electric forces. Accordingly, it is possible to obtain a larger air through-put than if a filter of a different material were used. Specifically, it is permissible to obtain a throughput of any value, whether fixed or variable, in the range of 0–900 cu.ft./min., for example, without the need for large, noisy, energy consuming air movers. A preferred range, in accordance with the invention, is 0–300 cu.ft./min. The main filter is highly effective on submicron particles and is up to 5 times more effective than similar sized competitive elecrostatic precipitator units without creating hazards associated with ozone or requiring frequent cleaning or maintenance. As the filter becomes loaded with particulate contamination it begins to block up and the process of continued collection by electrical forces gives way to collection by mechanical trapping similar to the HEPA filters as the fibers become entirely covered in captured particles.

When the filter becomes "loaded", usually after about one year of normal use, it is replaced by simply folding a new blanket type piece of filter media into the readily accessible perforated sheet metal filter carrier 7, which is a permanent part of the cabinet. The carrier may be made of slotted steel sheet as previously noted. This is a unique method of filter media use. There are no glued or framed seals around the filter and only the filter media itself is replaced. This is possible only because the low resistance to air flow results in a very low pressure drop across the filter such that the problems of air bypassing the filter through small spaces on the edge of the filter media are insignificant. In this way, the filter media is used very efficiently and a permanent pleated filter cartridge (as shown in U.S. Pat. No. 3,853,529) is not required, nor is a glued foam backing (as shown in U.S. Pat. No. 4,099,943) required.

By positioning the negative ion source external to the unit but flush with its surface the negative ions thus produced experience no interference to their movement and quickly accelerate into the surrounding air space. This results in a level of ionization that is orders of magnitude better (approximately 1000 times) than that which could be achieved if the source were placed internal to the unit behind a plastic diffuser or protective barrier as taught in U.S. Pat. No. 4,133,652.

Figure 3:
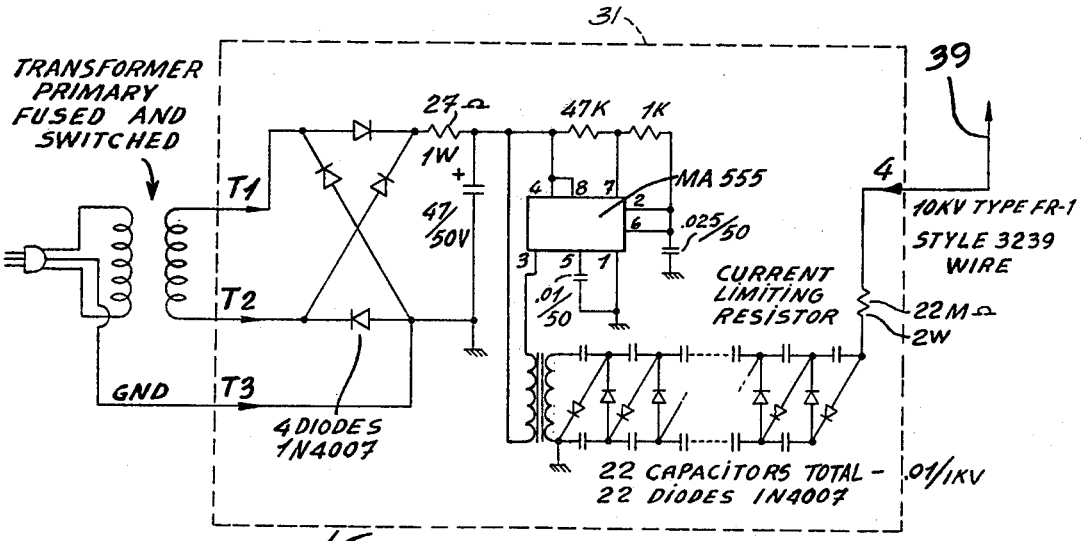
FIG. 3 is a circuit diagram of a printed circuit board that includes a power supply with facilities for limiting current to the negative ion source to protect users from receiving hazardous electrical shocks from the exposed negative ion source.

As a result of being external, the negative ion source presents a potential electrical shock hazard to the user. (It is at a potential of approximately 10,000 volts). This disadvantage is overcome by the innovative use of an ion source power supply having current limiting protection circuitry 31 as shown in FIG. 3. As soon as current begins to be drawn as a result of the emitter point of the ionizer needle 39 being touched, the circuitry quickly brings the output voltage to zero before a shock can be felt. Current limiting circuitry capable of performing this function is well known and need not be described in detail, FIG. 3 illustrating a preferred form of such a circuit that employs a current limiting resistor. (T1-T4 indicate input and output terminals of circuit board 31 of FIG. 3. The numbers adjacent to the connection wires of block MA555 refer to integrated circuit pin numbers.)

Thus the invention achieves a unique level of very clean, highly negatively ionized air in the room in which it is placed. The levels of cleanliness and sterility are so good (almost 100% sterility as confirmed under test) that the unit is useable in operating theaters of hospitals.

Although a single preferred embodiment has been described, it will be apparent to one skilled in the art that various changes and modifications can be made without departing from the principles and spirit of the invention, the scope of which is defined in the appended claims.

I claim:

1. An air cleaner unit comprising:

a casing having an air inlet and an air outlet and defining an air cleaning path between said air inlet and said air outlet;

filter means disposed across said path between said air inlet and said air outlet and comprising fibers shredded or fibrillated from a non-carcinogenic plastic membrane which has been permanently electrostatically charged;

air moving means disposed along said path for moving the air from said air inlet to said air outlet;

an exposed negative ion source disposed on the external surface of said air outlet; and a power supply connected to the negative ion source, the power supply having means for limiting the current of said power supply to protect users from receiving hazardous electrical shocks from said exposed negative ion source.

2. A unit as defined in claim 1 wherein said air moving means comprises fan means for drawing in air evenly across said air inlet and for distributing said air evenly outwardly across said air outlet.

3. A unit as defined in claim 2 wherein said fan means comprises a cylinder with a plurality of paddles extending outwardly from the surface thereof, said paddles being spaced along the periphery of the cylinder, and each paddle extending along the length of the cylinder.

4. A unit as defined in claim 3 wherein the axis of said cylinder is parallel to the plane of the air outlet, each of said paddles extending parallel with said axis.

5. A unit as defined in claim 1 further comprising:

an inlet duct disposed in said casing and facing said air inlet;

said filter means comprising a main filter and a carrier positioned in said inlet duct for supporting the main filter; and prefilter means disposed across said path between said air inlet and said first-mentioned filter means for removing particles in excess of approximately ten microns in diameter from the air entering said air inlet, said prefilter means resting on said first-mentioned filter means.

6. A unit as defined in claim 5 wherein said carrier is corrugated in shape and consists of slotted sheet steel.

7. A unit as defined in claim 5 wherein said prefilter means comprises a porous polyurethane material.

8. An air cleaner unit comprising:

a casing having an air inlet and an air outlet and defining an air flow path between said air inlet and said air outlet;

a grill covering the air outlet;

air moving means disposed along said path for providing an air flow from said air inlet to said air outlet;

filter means disposed across said path between said air inlet and said air outlet, said filter means comprising a plurality of electrically charged fibers for efficiently cleaning the air flowing from the air inlet to the air outlet; and a negative ion source located at said grill for producing ions of the cleaned air, said ion source being exposed at the air outlet for providing substantial emission of said ions into the air external to the grill without impediment from charge build-up on the grill.

9. The unit of claim 8, wherein said filter means comprises fibers shredded or fibrillated from a permanently charged foil.

10. The unit of claim 9, wherein said permanently charged foil comprises a non-carcinogenic plastic membrane which has been permanently electrostatically charged.

11. The unit of claim 8, wherein said filter means comprises a filter and a carrier for said filter, said carrier having a corrugated shape and comprising a slotted sheet.

12. The unit of claim 11, wherein said filter comprises a blanket of fibers supported in the corrugations of said carrier.

13. The unit of claim 8 further comprising another filter means disposed across said path between said air inlet and the first-mentioned filter means for removing particles in excess of a predetermined size from the air entering said air inlet.

14. The unit of claim 13, wherein said other filter means comprises a porous polyurethane material.

* * * * *